US006820819B2

(12) United States Patent
Sperber

(10) Patent No.: US 6,820,819 B2
(45) Date of Patent: Nov. 23, 2004

(54) CONTROLLING INSULATION DENSITY

(75) Inventor: Henry Sperber, Englewood, CO (US)

(73) Assignee: Ark Seal, LLC, Denver, CO (US)

( * ) Notice: Subject to any disclaimer, the term of this patent is extended or adjusted under 35 U.S.C. 154(b) by 304 days.

(21) Appl. No.: 10/108,947

(22) Filed: Mar. 27, 2002

(65) Prior Publication Data

US 2003/0183703 A1 Oct. 2, 2003

(51) Int. Cl.[7] ..... A62C 5/02

(52) U.S. Cl. ..... 239/8; 239/11; 239/418; 239/419; 239/423; 239/430; 239/433

(58) Field of Search ..... 239/8, 9, 10, 11, 239/418, 419, 419.3, 420, 422, 423, 424.5, 425, 427.5, 428, 429, 430, 433

(56) References Cited

U.S. PATENT DOCUMENTS

| | | | | |
|---|---|---|---|---|
| 4,225,086 A | * | 9/1980 | Sandell | 239/428 |
| 4,239,397 A | * | 12/1980 | Sandell et al. | 239/430 |
| 4,411,389 A | * | 10/1983 | Harrison | 239/427.5 |
| 4,421,797 A | * | 12/1983 | Koehne | 239/427.5 |
| 4,487,365 A | | 12/1984 | Sperber | 239/8 |
| 4,530,468 A | | 7/1985 | Sperber | 239/419.3 |
| 4,768,710 A | | 9/1988 | Sperber | 239/8 |
| 5,131,590 A | | 7/1992 | Sperber | 239/8 |
| 5,389,167 A | | 2/1995 | Sperber | 156/71 |
| 5,393,794 A | | 2/1995 | Sperber | 521/78 |
| 5,421,922 A | | 6/1995 | Sperber | 156/71 |
| 6,316,510 B1 | | 11/2001 | Sperber | 521/94 |

FOREIGN PATENT DOCUMENTS

| | | |
|---|---|---|
| DE | 9410491 | 8/1994 |
| EP | 0484873 | 5/1992 |
| EP | 0780528 | 6/1997 |

* cited by examiner

*Primary Examiner*—Robin O. Evans
(74) *Attorney, Agent, or Firm*—Sheridan Ross P.C.

(57) ABSTRACT

A mixing device for outputting wet insulation is provided. The mixing device includes a nozzle and a plurality of control apertures that control penetration of a wetting material, such as foam with a binder, into insulation particles that are being forcibly moved through the nozzle. The control apertures can be used to provide a spray output and/or control the insulation density associated with the wet insulation output by the nozzle. The control apertures can be part of a primary conduit that can be adjustable or removable relative to a receiver space of the nozzle. Depending on the relative location of the control apertures in the nozzle receiver space, a desired insulation density can be achieved. Different primary conduits can also be provided having one or more of a different number of control apertures, sizes of the control apertures and positions thereof.

15 Claims, 3 Drawing Sheets

70
62
40
140
144
36
66
50
110
54
28

CONTROLLING INSULATION DENSITY

FIELD OF THE INVENTION

The present invention relates to installing wet insulation and, in particular, supplying insulation to an area being insulated using a mixing device that can control insulation density.

BACKGROUND OF THE INVENTION

According to one well-established way of installing insulation, insulation particles are output from a nozzle using the force of pressurized air. In one category of installing insulation using such a nozzle and pressurized air, the insulation particles are wetted before they are output from the nozzle. The wetting material can include a binder or adhesive that is useful in maintaining positions of the insulation particles relative to each other after drying of the wetting material. The wetting material can also be a foamable material that is in a foamed state when insulation particles are combined with such wetting material. The combination of insulation particles and foam material, including binder, is held in place in the cavity being insulated using the binder and the foamed insulation subsequently dries in the cavity.

Although the equipment and method of installing foamed insulation are satisfactory for their intended purposes, it would be beneficial to incorporate additional features. When installing insulation, it is desirable to provide a predetermined insulation density. Depending on the building or other object being insulated, it may be that different buildings or different areas of the same building might require greater or lesser insulation density. It would be, therefore, worthwhile to be able to adjust the insulation density while using the same, or essentially the same, equipment. Some installations of insulation may require a greater application of force in delivery of the wet insulation. The degree or amount of force may be a function of the location and/or type of object or cavity being insulated. Thus, it would be advantageous to provide a mixing device and method of applying wet insulation that achieves at least these further objectives.

SUMMARY OF THE INVENTION

In accordance with the present invention, a mixing device is provided for delivery of wet insulation to a building cavity or other object or item that is to be insulated. The mixing device includes a nozzle and a plurality of control apertures through which wetting material (e.g., a binder that is foamed and/or includes another material that is foamed) passes and penetrates into insulation particles, as they are being forcibly moved using pressurized air. The control apertures are located relative to the insulation particles so that the wetting material sufficiently penetrates them. In one embodiment, the control apertures are formed in a primary conduit or adjustable connector. When sufficient penetration occurs, density of the resulting wet insulation is better controlled and a more forceful wet insulation passes from the outlet of the nozzle. A more forceful wet insulation can result in a spray thereof escaping from the nozzle. In certain applications, it is beneficial for the cavity, building unit or other object being insulated to be contacted with a spray of wet insulation. These applications might include difficult-to-access pipes, cavities or items located at a relatively greater distance from the nozzle and/or objects that require that the wet insulation strike it with greater force to achieve better holding action of the wet insulation to the object being insulated. The insulation particles can include one or more of a variety of well-known materials or fibers, such as mineral fibers, paper and fiberglass. Insulation particles that include ceramic fibers provide desired fireproofing attributes. Related to achieving the desired insulation density, the pressure of the wetting material as it exits through the control apertures substantially increases over its pressure before entry into the control apertures. In one embodiment, such exit pressure is at least 50 psi and preferably greater than about 75 psi. This increased pressure of the wetting material enhances penetration thereof into the insulation particles as they move through the adjustable connector and exit the outlet end of the nozzle. The control apertures optimize, or at least facilitate, proper combining of the wetting material and the insulation particles. Proper combining can be measured or determined by the amount of wetting material required to achieve two important objectives: (i) sufficient penetration or wetting of the dry insulation particles so that desired or appropriate sticking or holding of the wet insulation to the object being insulated occurs and (ii) none, or substantially none, of the dry insulation particles is airborne after escaping the nozzle; instead, all, or substantially all, of the insulation particles are part of the wet insulation that outputs the nozzle.

In one embodiment in which the control apertures are part of the hollow adjustable connector, this connector or primary conduit or a tube is joined to the nozzle, with at least portions thereof held in the receiver space of the nozzle, which is the volume defined or bounded by the inner surfaces or walls of the nozzle. The primary conduit carries the insulation particles that are to be wetted. The control apertures are formed adjacent to the end of the primary conduit that is inserted into the receiver space. The control apertures can be formed in one or more circumferential sets of apertures. Each circumferential set of apertures is defined as being positioned about one circumferential section of the adjustable connector. The number, sizes and/or positions of the control apertures can vary. The adjustable connector can be moved inwardly/outwardly relative to the receiver space, as well as rotatably moved, so that the control apertures are adjustably positioned in the receiver space. Depending upon their positions, penetration of the wetting material, which is transported using a secondary conduit, into the insulation particles can be controlled. In one embodiment, more inward movement of the control apertures into the receiver space results in greater insulation density being achieved, as at least some, if not a majority or all, of the wetting material passes from the secondary conduit to the primary conduit through the control apertures. Conversely, relatively more outward positioning of the control apertures results in relatively less insulation density. When the adjustable connector is located further inward of the receiver space, in one embodiment, there is less, if any, space or gap between the inner surface of the nozzle and the outer surface of the adjustable connector that would permit wetting material to by-pass the control apertures and pass through any such gap. This results in more, if not all, of the wetting material being forced to pass through the control apertures and penetrate the insulation particles that are being forcibly moved through the hollow of the adjustable connector. In another embodiment or alternative, the receiver space of the nozzle may be configured such that one or some control apertures, in whole or in part, may be blocked by portions of the inner surface of the nozzle thereby reducing the number of control apertures through which the wetting material can pass into the hollow of the adjustable connector.

In the embodiment that has the adjustable connector, it is preferred that it include one or more marks or indicia that identify for the operator or user predetermined positions of the adjustable connector that correspond to a desired penetration of wetting material into the insulation particles and/or correlate with a predetermined insulation density. Each such mark on the adjustable connector, when positioned relative to the nozzle, results in the predetermined or desired insulation density based on the wet insulation that is output from the nozzle.

Based on the foregoing summary, a number of advantages of the present invention can be identified. A mixing device is disclosed that can output sprayed wet insulation for insulating desired objects, such as buildings including portions thereof. The insulation density associated with the wet insulation can be controlled by means of an adjustable connector and/or substitutable connector(s) with different control apertures. Substantial increased pressure of wetting material is provided to achieve desired penetration of wetting material into the insulation particles. In one embodiment, the wetting material can be a foam that might include a foamable binder. The relatively dry insulation particles are advantageously wetted so that desired sticking of the wet insulation to the object being insulated occurs. Relatedly, virtually all the insulation that escapes from the mixing device is part of the wet insulation and not unwanted airborne particles. The wet insulation can have fireproofing qualities to achieve suitable fire protection of the object being insulated.

Additional advantages of the present invention will become readily apparent from the following discussion, particularly when taken together with the accompanying drawings.

DETAILED DESCRIPTION

Figure 1:
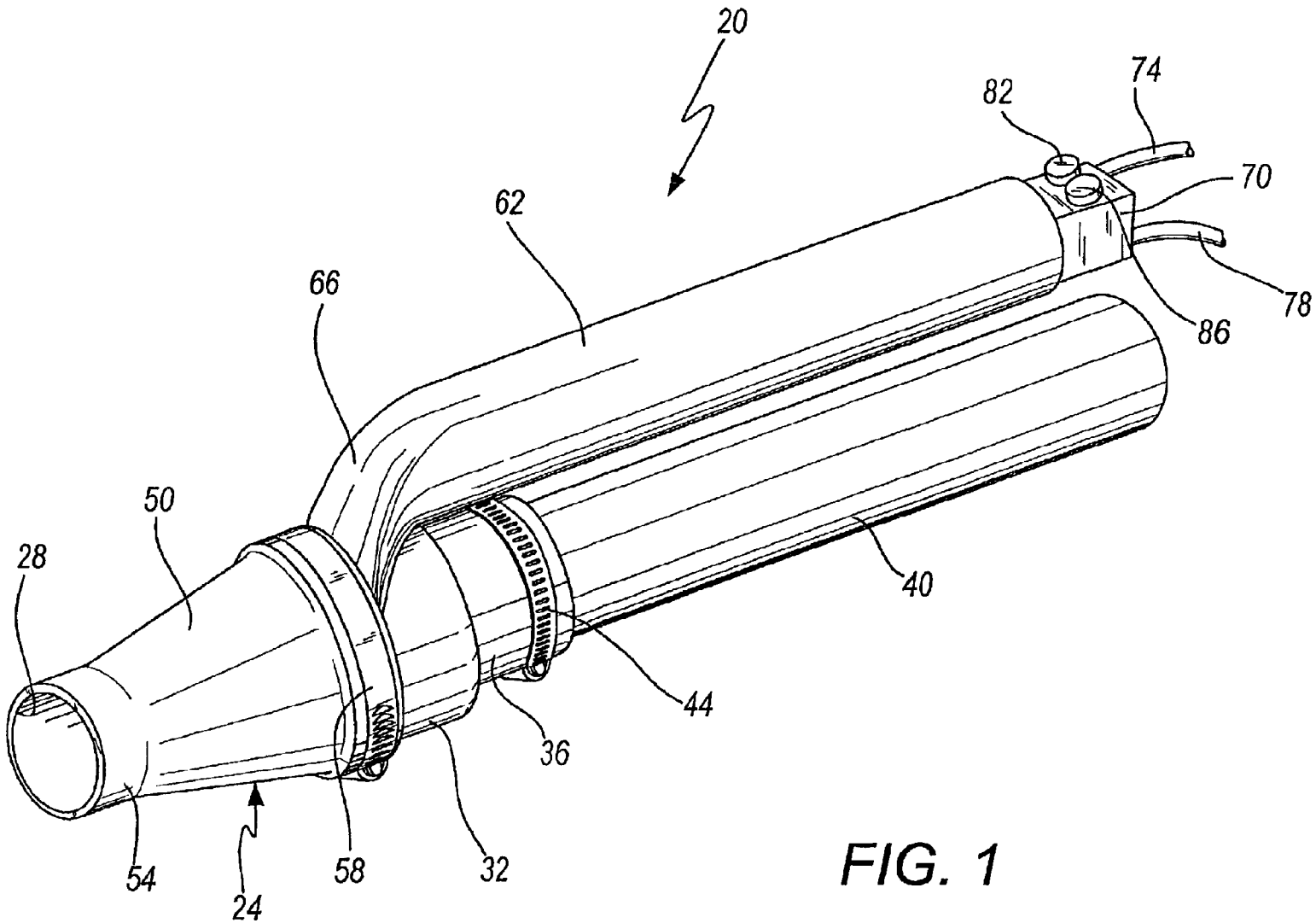
FIG. 1 is a perspective view of the mixing device of the present invention.

With reference to FIG. 1, a mixing device 20 is illustrated for use in outputting a wet insulation that is delivered under pressure, sprayed or otherwise output to a building cavity or other object to be insulated. The mixing device 20 includes a nozzle 24 having a receiver space or hollow volume 28 that is bounded by the inner surface or walls of the nozzle 24. The nozzle 24 has a number of portions or sections including a body 32 and a collar 36 that is integral with or otherwise joined to the body 32. A primary conduit/tube or adjustable connector 40 is insertable into the nozzle 24 at the collar 36 and extends for a desired distance into the receiver space 28 of the nozzle 24. As will be described in more detail later, the adjustable connector 40 can be located at more than one selected position relative to the receiver space 28 and other parts of the nozzle 24. In one embodiment, a collar clamp 44 is disposed about the periphery of the collar 36 and is useful in holding or otherwise joining the primary conduit 40 to the nozzle 24.

Extending from the opposite end of the body 32 is a cone or tapered section 50 that terminates in an outlet section or end 54. The body 32 may be integral with the cone section 50. In one embodiment, the body 32 is held or otherwise joined to the cone section 50 using a cone clamp 58. When using the mixing device, relatively dry insulation particles are received by the primary conduit 40 and carried by it under the force of pressurized air to where the insulation particles are to be combined with a wetting material, in one or both of the end portions of the primary conduit 40 and those portions of the receiver space 28 that are downstream of the primary conduit 40.

In conjunction with providing the wetting material to be combined with the relatively dry insulation particles, the mixing device 20 includes a secondary conduit 62 having an outlet passage 66 from which the wetting material exits the secondary conduit 62. The wetting material is received by the secondary conduit 62 at its opposite end using an end connector 70 to which a first or wetting material feed line 74 and a second or pressurized air feed line 78 is joined. The first feed line 78 transports or carries a wetting material that is to be combined with the relatively dry insulation particles carried by the primary conduit 40. In one embodiment, the wetting material includes at least a binder or adhesive that is to be combined with the insulation particles. In another embodiment, the wetting material includes an adhesive binder and a foamable component or substance mixed with the adhesive binder to facilitate a foaming of such wetting material. In another embodiment, the adhesive binder itself is sufficiently foamable to provide a desired foamable wetting material. The pressurized air supplied by the second feed line 78 combines with the wetting material to force the wetting material along the secondary conduit 62 and eventually through the outlet passage 66. In the illustrated embodiment, also operably associated with the end connector 70 is a first or wetting control valve or part 82 and a second or pressurized air valve or part 86, each of which can be used to control input of its respective constituent, namely, the wetting material and the pressurized air and its ability to enter or pass into the secondary conduit 62. Typically, the force of the pressurized air at the juncture of the end connector 70 and the second feed line 78 is less than about 5 psi. Hence, the wetting material carried along the secondary conduit 62 is at a relatively low pressure. Similarly, the relatively dry insulation particles carried along the primary conduit are at a comparable pressure, i.e., less than about 5 psi.

Figure 2A:
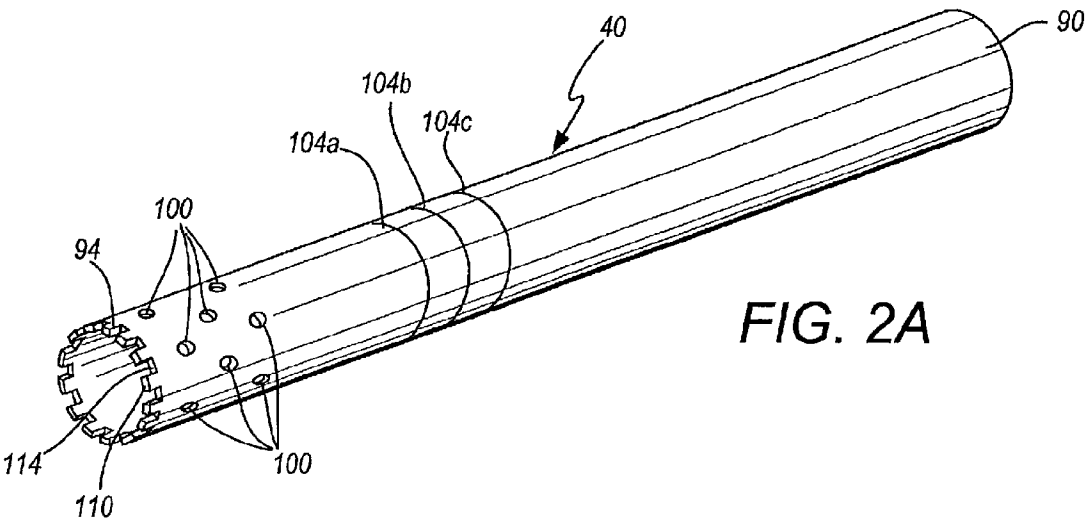
FIG. 2A illustrates one embodiment of an adjustable connector with certain control apertures.

Referring to FIG. 2A, one embodiment of an adjustable connector or primary conduit 40 is illustrated removed from the nozzle 24. The primary conduit 40 has an inlet or proximal end 90 and an outlet or distal end 94. More adjacent to the distal end 94 than to the proximal end 90 are a number of control apertures 100 formed through the cylindrical wall of the primary conduit 40. The control apertures 100 are important in achieving desired penetration of the wetting material into the insulation particles as they are being carried in the primary conduit 40 past the control apertures 100 using the pressurized air. The locations, number and sizes of one or more control apertures 100 can vary over a very wide range so long as the main objective of sufficient penetration of wetting material into insulation particles is achieved. In the embodiment of FIG. 2A, the control apertures 100 have the same, or essentially the same, size with a diameter of about 0.125 inch. These control apertures 100 of this embodiment can be defined as comprising three sets of circumferential control apertures 100, with each set having six control apertures 100 and the second or intermediate set of control apertures 100 being offset from the first and third sets in a direction along the longitudinal extent or length of the primary conduit 40. Regardless of the locations, number and sizes of the control apertures 100, it is preferred that each of them be used in providing an opening for the wetting material to enter into the interior or hollow of the primary conduit 40. Depending on the position of the primary conduit 40 and, therefore, the control apertures 100 relative to the receiver space 28 of the nozzle 24, a controlled, different insulation density can be achieved. In connection with outputting from the mixing device 20, a desired, predetermined or selected controlled insulation density, one or more marks 104 or other indicia can be formed or otherwise located with the primary conduit 40 along its outer surface. Each of the marks 104*a*, 104*b*, 104*c* corresponds to or correlates with a predetermined insulation density, when the particular one of such marks 104 is located in a predetermined position relative to the nozzle 24. Such a predetermined position can be relative to the end of the collar 36. In one embodiment, if the predetermined mark 104*a* is immediately adjacent to the end of the collar 36, a first predetermined insulation density can be achieved, while second and third predetermined insulation densities can be achieved when the marks 104*b*, 104*c* are alternatively located immediately adjacent to the end of the collar 36, respectively.

With respect to making determinations for locating the marks 104 on the primary conduit 40, the mixing device 20 with such a primary conduit 40 can be used to output wet insulation that is a combination of the wetting material and the insulation particles. Outputted wet insulation can be measured or otherwise analyzed for each one of a number of positions of the primary conduit 40 relative to the nozzle 24. For a particular position of the primary conduit 40 and based on such measuring or analysis of the outputted wet insulation, a determination is made related to its insulation density. This procedure can be followed for each of a number of different positions of the primary conduit 40 relative to the nozzle 24. Measurements and analyses can be conducted for each of the positions. From this, one or more of a number of marks 104 can be provided. As should be appreciated, the number of marks 104 need net correspond or be equal to the number of sets of control apertures 100. Furthermore, each mark can include a number or other identifier that accurately conveys to the operator the particular insulation density that is intended to result from a predetermined position of that particular mark 104.

Also illustrated in the embodiment of FIG. 2A are a number of teeth 110 that are formed in and emanate from the distal end 94 of the primary conduit 40. The teeth 110 can be of a number of different sizes, including different lengths and widths, as well as a varied number thereof. Gaps 114 are defined between pairs of teeth 110. In one embodiment, the formation of the teeth 114 facilitate insertion and positioning of the primary conduit 40 relative to the receiver space 28 of the nozzle 24. The teeth 110 may also be useful in providing desired paths of wetting material that does not pass through the control apertures 100 and/or does not pass between the inner surfaces of the nozzle 24 and the outer wall surfaces of the primary conduit 40. Stated another way and depending on the position of the primary conduit 40 in the receiver space 28, the wetting material can have different paths after exiting the secondary conduit 62 including: through the control apertures 100, through the gaps 114 past the teeth 110, and between the inner and outer surfaces of the nozzle 24 and the primary conduit 40, respectively.

Figure 2B:
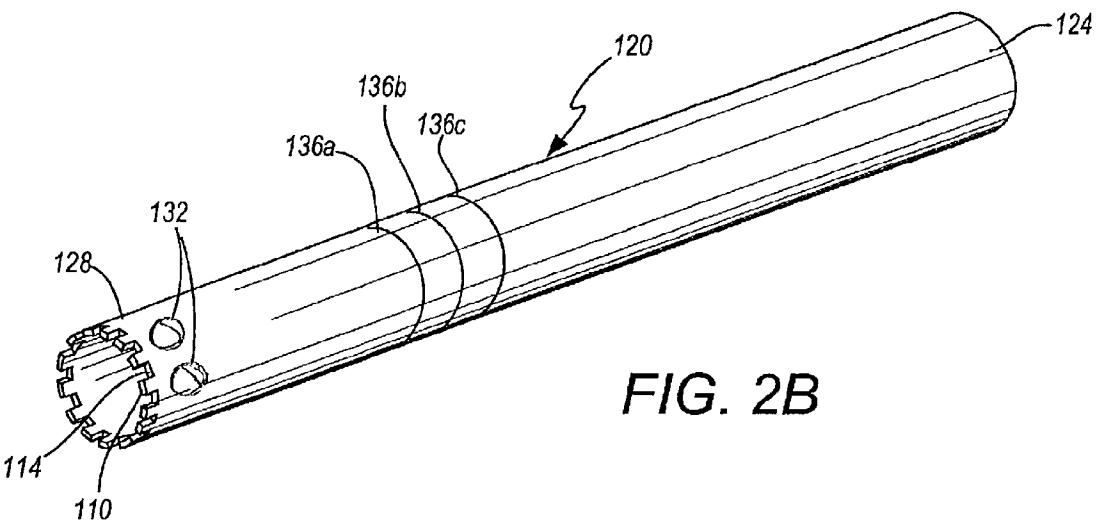
FIG. 2B is a perspective view of another embodiment of an adjustable connector with different control apertures.

Referring to FIG. 2B, another embodiment of a primary conduit 120 is illustrated that has a proximal end 124 and a distal end 128. Adjacent to the distal end 128 are a number of control apertures 132. In this embodiment, the control apertures 132 are greater in size than the control apertures 100, as well as there being fewer of such control apertures 132, including only a first set of control apertures 132 formed in the primary conduit 128 about a circumferential section thereof. In this embodiment, there can be, for example, four control apertures 132 located along the same circumferential section of the primary conduit 120. This embodiment also has three marks 136 or indicia that are useful in positioning the primary conduit 120 in the receiver space 28 of the nozzle 24 in order to obtain a desired insulation density being output from the outlet 54 of the nozzle 24. Like the embodiment of FIG. 2A, when using the mark 136*a*, less insulation density is achieved than when using or relying on the mark 136*c*. As should be understood, one or more primary conduits can be used with the same nozzle 24 in connection with achieving a desired insulation density. For example, the primary conduit 120 could replace or be a substitute for the primary conduit 40 in connection with a particular application or use of the mixing device 20.

Figures 3, 4, 5:
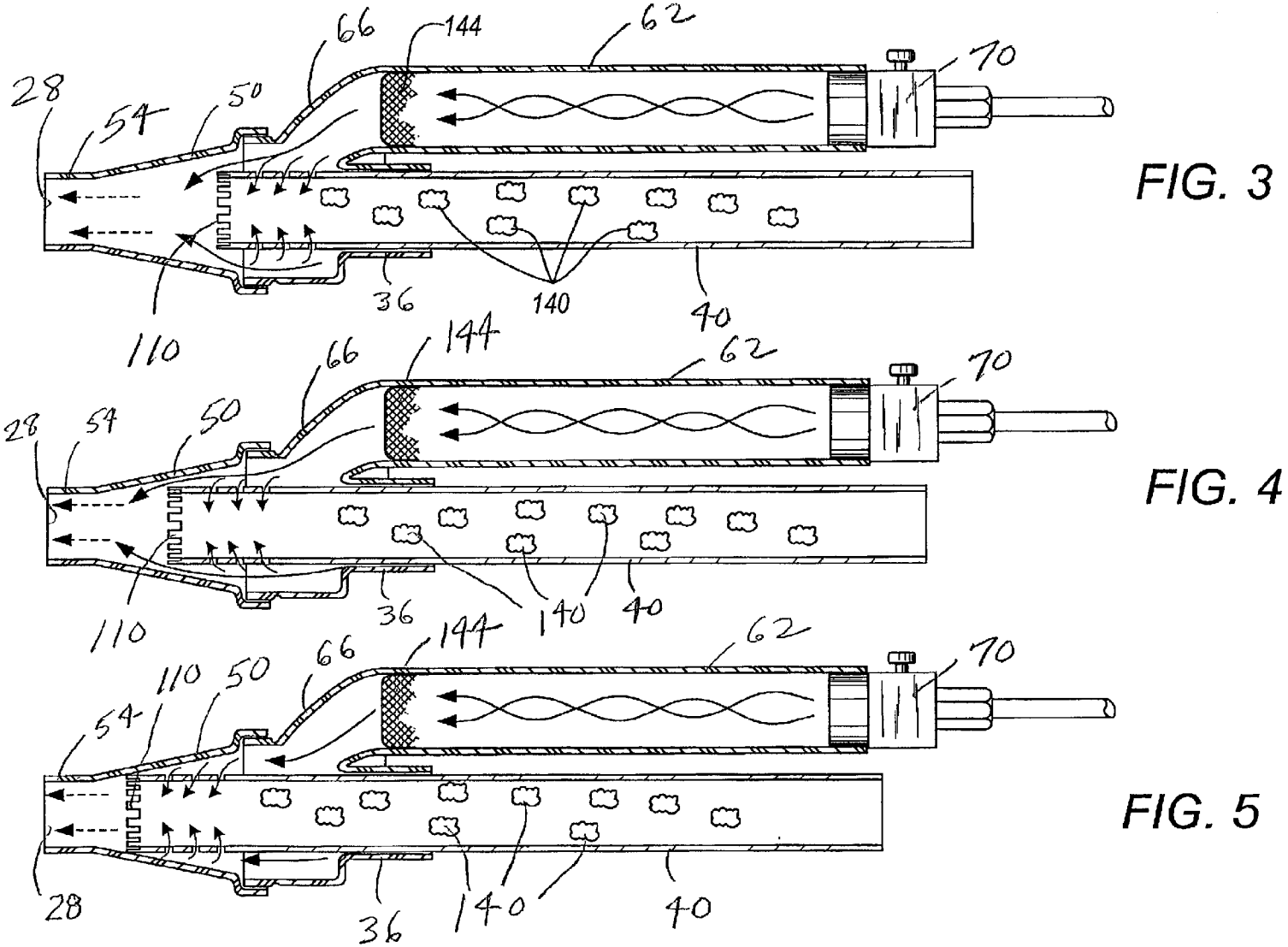
FIG. 3 is a longitudinal section of the mixing device illustrating the adjustable connector in a first position whereby a first insulation density associated with the wet insulation material is achieved.
FIG. 4 is a longitudinal section, similar to FIG. 3, but with the adjustable connector located relatively more inwardly of the nozzle to achieve a wet insulation having a second insulation density greater than the first insulation density.
FIG. 5 is a longitudinal section, similar to FIG. 4, but with the adjustable connector located relatively more inwardly in the nozzle to achieve a wet insulation having a third insulation density greater than the second insulation density.

With reference to FIGS. 3–5, more descriptions are provided related to use of the mixing device 20, particularly related to some of the possible or available positions of the primary conduit 40 relative to remaining parts of the mixing device 20 including the receiver space 28 of the nozzle 24. With reference initially to FIG. 3, a first predetermined position of the adjustable connector or primary conduit 40 is illustrated in which the primary conduit 40 is located less inwardly and more outwardly of the nozzle 24. In this embodiment or position, a first controlled insulation density can be obtained by desired or sufficient penetration of the wetting material into the insulation particles 140 that are carried by the primary conduit 40. In particular, some of the wetting material from the output 66 of the secondary conduit 62 enters the control apertures 100 and passes through them for contacting and penetrating the insulation particles 140 that are being forced under pressurized air beneath the control apertures 100 and towards the distal end 94 of the primary conduit 40. Some wetting material from the secondary conduit 62 is illustrated as not entering into one or more control apertures 100. Instead, such wetting material continues past the distal end 94 of the primary conduit 40, either between the inner and outer surfaces of the nozzle 24 and the primary conduit 40, respectively, or, when present, between the teeth 110 in the gaps 114, when such are part of the primary conduit 40. In any event, such wetting material can also combine with the insulation particles that may at that position in the receiver space 28 be also combined with insulation particles that have already been wetted by the wetting material that was received from the control apertures 100. The first predetermined position can correlate with the first mark 104*a*. This cross section illustration also depicts a baffle 144 that is located relatively more adjacent to the outlet passage 66 of the secondary conduit 62 than it is to the opposite end thereof, which has the end connector 70. The baffle 144 can have a number of holes and is useful in foaming the wetting material, when it is advantageous or desired to have a foamed wetting material.

Referring next to FIG. 4, a second predetermined position of the primary conduit 40 is illustrated in which the primary conduit 40 is located more inwardly and less outwardly of the nozzle 24 than in the first predetermined position of FIG. 3. In this position, a relatively greater insulation density results from the wet insulation being output at the outlet 54 of the nozzle 24. Less space or less of a gap is available for wetting material from the secondary conduit 62 to escape pass the distal end 94 of the primary conduit than is available in the first predetermined position of FIG. 3. Consequently, relatively more wetting material passes through the control apertures 100 and penetrates the insulation particles 140 to provide the desired or sufficient insulation density when the primary conduit 40 is in this second predetermined position.

Referring lastly to FIG. 5, this illustrates a third predetermined position of the primary conduit 40 that is located more inwardly relative to the nozzle 24 than the first and second predetermined positions. In this third predetermined position, the distal end 94 of the primary conduit 40 is disposed in contact with portions of the inner surface of the nozzle 24 whereby no wetting material, or substantially none, passes between the inner and outer surfaces of the nozzle 24 and the primary conduit 40, respectively. Instead, all, or substantially all, wetting material passes through the control apertures 100 and/or through the gaps 114 between the teeth 110, when present. In the third predetermined position of FIG. 5, greater or more optimum spraying of the wet insulation occurs that exits the outlet 54 of the nozzle 24. Furthermore, the greater insulation density associated with the wet insulation is achieved, particularly in comparison with the positions of FIGS. 3 and 4, since better opportunity for penetration of the wetting material into the insulation particles is made available by this third predetermined position of the primary conduit 40. In that regard, the wetting material that exits the control apertures 100 has a relatively great force or pressure associated therewith that constitutes a major factor in providing the desired or sufficient penetration of wetting material into the insulation particles 140 as they are carried by in the primary conduit 40. This force is preferably at least 50 psi and, more preferably, at least about 75 psi, although other forces or pressures may be possible, both greater and lesser than these so long as sufficient or desired penetration or combination of wetting material with insulation particles occurs. This compares with a much smaller force associated with the wetting material being carried through the secondary conduit 62 and the insulation particles 140 being carried through the primary conduit 40. The forces associated with the wetting material and the insulation particles 140 as they are moving along their respective conduits 62, 40 are typically less than about 5 psi, although greater forces or pressures may be present. Based on the operation of the control apertures 100, each of the selected positions of the primary conduit 40, including the three predetermined positions of FIGS. 3–5, provides sufficient wetting of the dry insulation particles 140 so that relatively dry insulation particles do not exit the nozzle 24 and are not airborne after escaping from the mixing device 20. Rather, all, or substantially all, of the insulation particles 140 are wetted by the wetting material for exiting the nozzle 24 and will properly adhere to the object being insulated. In comparison with devices that do not have the control apertures 100, for the same amount of wetting material that is supplied to combine with the insulation particles in such prior art devices, a greater percentage of such insulation particles can become airborne and not be sufficiently combined with the wetting material. Consequently, to make sure that all, or substantially all, of the dry insulation particles are sufficiently wetted, more wetting material is used in such prior art devices than is required when the control apertures 100 of the present invention are included since more effective and efficient penetration of wetting material occurs due to these apertures 100.

The foregoing discussion of the present invention has been presented for purposes of illustration and description. Furthermore, the description is not intended to limit the inventions to the forms disclosed herein. Consequently, further variations and modifications commensurate with the above teachings, within the skill and knowledge of the relevant art, are within the scope of the present invention. The embodiments described hereinabove are further intended to explain the best mode presently known for practicing the invention and to enable others skilled in the art to utilize the invention in such, or in other, embodiments and with various modification(s) required by the particular application or use of the invention. It is intended that the appended claims be construed to include alternative embodiments to the extent permitted by the prior art.

What is claimed is:

1. A mixing device for delivery of wet insulation, comprising:

a nozzle including a receiver space and an outlet for outputting wet insulation;

a secondary conduit for carrying a wetting material; and a primary conduit having a plurality of control apertures in communication with said secondary conduit from which the wetting material exits and combines with insulation particles, said primary conduit having portions within said nozzle receiver space and also having an outlet end from which wet insulation exits, said outlet end of said primary conduit being different than said plurality of control apertures and said primary conduit outlet end being located downstream of said plurality of control apertures, said primary conduit including said plurality of control apertures and said outlet end thereof being adjustably positioned relative to said receiver space.

2. A mixing device, as claimed in claim 1, wherein:

said primary conduit has at least first and second positions, the wet insulation having a first predetermined insulation density when said primary conduit is in said first position and the wet insulation having a second insulation density when said primary conduit is in said second position.

3. A mixing device for delivery of wet insulation, comprising:

a nozzle including a receiver space and an outlet for outputting wet insulation;

a secondary conduit for carrying a wetting material;

a primary conduit having portions within said nozzle receiver space and including a plurality of control apertures in communication with said secondary conduit from which a wetting material exits and combines with insulation particles, said primary conduit for carrying the insulation particles; and a second primary conduit having a plurality of control apertures in which said control apertures of said second primary conduit are different from said control apertures of said primary conduit in at least one of number and a size.

4. A mixing device, for delivery of wet insulation, comprising:

a nozzle including a receiver space and an outlet for outputting wet insulation;

a secondary conduit for carrying a wetting material; and a primary conduit including a plurality of control apertures and an outlet end and being in communication with said secondary conduit from which a wetting material exits and combines with insulation particles, said primary conduit outlet end is adjacent to a plurality of teeth past which at least some of said wetting material moves, said primary conduit having portions within said nozzle receiver space and said primary conduit for carrying the insulation particles.

5. A mixing device, as claimed in claim 1, wherein:

said plurality of control apertures are of a number and a size such that the wetting material exits said control apertures with the force of at least 50 psi.

6. A mixing device, as claimed in claim 1, further including:

a barrier held with said secondary conduit and having a number of holes useful in foaming the wetting material, said barrier located upstream of said control apertures.

7. A mixing device, as claimed in claim 1, wherein:

said primary conduit is located in said receiver space such that substantially all the wetting material passes through said plurality of control apertures.

8. A mixing device, for delivery of wet insulation, comprising:

a secondary conduit for carrying a wetting material; and a primary conduit including a plurality of control apertures in communication with said secondary conduit from which a wetting material exits and combines with insulation particles, said primary conduit having portions within said nozzle receiver space and said primary conduit for carrying the insulation particles, said primary conduit having an outlet end that includes a number of teeth wherein wetting material can move between said teeth.

9. A method for controlling delivery of insulation, comprising:

providing a mixing device that includes a plurality of control apertures;

locating said control apertures in a first position relative to a receiver space of said mixing device;

supplying wetting material through at least some of said control apertures;

combining said wetting material with insulation particles;

outputting a wet insulation from said mixing device associated with a first insulation density; and changing said control apertures from said first position to a second position associated with a second density of said wet insulation.

10. A method, as claimed in claim 9, further including:

providing another plurality of control apertures, with said another plurality of control apertures being different in at least one of: the number of said plurality of control apertures and a size of at least one of said another of said plurality of control apertures.

11. A method, as claimed in claim 9, wherein:

said supplying step includes causing said wetting material to exit said control apertures at a pressure of at least about 50 psi.

12. A method, as claimed in claim 9, wherein:

said control apertures are part of a primary conduit that is adjustable relative to said receiver space in conducting said locating step and said primary conduit has an outlet end from which wet insulation exits that is located downstream of said control apertures and in which said outlet end of said primary conduit moves with said control apertures from said first position to said second position.

13. A method, as claimed in claim 10, wherein:

said locating step includes using a first primary conduit having said plurality of control apertures and said changing includes using a second primary conduit having said another plurality of control apertures.

14. A method, as claimed in claim 9, further including:

foaming said wetting material utilizing a number of holes upstream of said supplying step.

15. A method for delivery of insulation, comprising:

providing a mixing device that includes a plurality of control apertures, said plurality of control apertures being part of an adjustable connector;

locating said control apertures in a first position relative to a receiver space of said mixing device;

supplying wetting material through at least some of said control apertures and in which said first position is such that at least a majority of said wetting material passes through said plurality of control apertures;

combining said wetting material with insulation particles; and outputting a wet insulation from said mixing device associated with a first insulation density.

* * * * *